United States Patent [19]

Bevelander

[11] Patent Number: 4,632,287

[45] Date of Patent: Dec. 30, 1986

[54] ACCESSORY FOR GARMENT HANGER

[76] Inventor: Alice K. Bevelander, P.O. Box 2656, Carmel, Calif. 93923

[21] Appl. No.: 832,118

[22] Filed: Feb. 24, 1986

[51] Int. Cl.[4] ..... A41D 27/22

[52] U.S. Cl. ..... 223/98

[58] Field of Search ..... 223/98, 88, 92

[56] References Cited

U.S. PATENT DOCUMENTS

| | | | |
|---|---|---|---|
| 2,591,163 | 4/1952 | Kivett | 223/98 |
| 2,596,576 | 5/1952 | MacSpadden | 223/88 |
| 2,675,948 | 4/1954 | Mallory | 223/98 |
| 2,902,192 | 9/1959 | Ericson et al. | 223/98 X |
| 3,301,447 | 1/1967 | Felton | 223/98 |
| 3,866,810 | 2/1975 | Florian | 223/98 X |

*Primary Examiner*—Werner H. Schroeder
*Assistant Examiner*—Andrew M. Falik
*Attorney, Agent, or Firm*—Townsend and Townsend

[57] ABSTRACT

A shoulder-supporting member defining an accessory for a wire garment hanger having a pair of inclined side segments extending downwardly and outwardly from a hook segment. In use, a pair of shoulder-supporting members are removably mounted on the garment hanger, there being a member for each inclined side segment, respectively. Each member has a hole at one end for removably receiving the hook segment of the garment hanger. Each member has a convex outer surface extending substantially along the length of the member. At the outer end of each member, a spherical end part has a pair of spaced, flat elements defining a slot for receiving the outer end of the corresponding inclined side segment to stabilize the member on the garment hanger. A pair of longitudinally spaced projections are integral with the inner surface of each member for frictionally engaging opposite side portions of the respective inclined side segment of the garment hanger.

1 Claim, 6 Drawing Figures

ACCESSORY FOR GARMENT HANGER

This invention relates to improvements in garment hangers and, more particularly, to an improved accessory for a garment hanger of the type made from a single length of wire.

BACKGROUND OF THE INVENTION

Garment hangers have been made for consumer and other uses in various sizes and shapes and various materials. The common ordinary garment hanger is the wire garment hanger made of a single strand of wire to present a hook segment, a pair of inclined side segments extending downwardly and outwardly from the hook segment, and a bottom segment interconnecting the outer ends of the inclined side segments. Garment hangers of this type are extremely simple and rugged in construction, are inexpensive to produce and replace, and have enough strength to support even relatively heavy garments.

A major drawback in the use of a wire type garment hanger is that the shoulders of a garment are not properly supported by the wire defining the inclined side segments of the hanger. The wire side segments are so small that creases often form in the shoulder area of the garment if the garment hangs on the hanger for any appreciable time. While garment hangers having padded or quilted side segments are commercially available, they are generally so expensive that only a relatively few number are purchased by a consumer for closet use.

Because of these drawbacks, a need has existed for improvements in garment hangers, especially of the type made from a single strand of wire, so that garments of all sizes, weights and shapes can be properly hung without causing creases in the shoulder regions thereof.

Prior disclosures in the garment hanger field include the following U.S. and foreign patents:

U.S. Pat. Nos. 2,074,071
2,123,369
2,219,520
2,434,461
2,591,163
2,813,668
3,301,447
3,680,747
3,886,810
Gr. Br. No. 1,111,063
Can. No. 696,161
U.S. Pat. No. 3,484,029

SUMMARY OF THE INVENTION

The present invention is directed to an improved accessory for a hanger in which the accessory provides a removable shoulder-supporting member for each inclined side of a wire-type garment hanger, so that additional support can be provided on the garment hanger for the shoulder regions of a garment to thereby assure that the garment will retain its normal shape without becoming creased even though the garment remains hanging on the garment hanger for long periods of time. The shoulder-supporting member of the present invention typically is used with another, identical shoulder-supporting member, and such members are shell-like in construction and are relatively wide so that they are especially suitable for use with conventional wire garment hangers although they could be used with other types of garment hangers. The members themselves can be quickly and easily placed on a garment hanger inasmuch as each member has a hole at one end for receiving the upper hook segment of the garment hanger.

Each member overlies and extends along a respective, inclined side segment of the garment hanger. Moreover, each member is provided with means for releasably coupling itself to the adjacent side of the garment hanger to stabilize the member so as to keep it from tilting or wobbling on the garment hanger during use. Such means defines an outer end slot on each member and a pair of longitudinally spaced projections for frictionally engaging oppositely facing surface portions of the adjacent side of the garment hanger. The slot is adapted for receiving the outer, generally curved end of the adjacent side in a press fit relationship. This effectively holds the adjacent shoulder-supporting member in a fixed position on the garment hanger to thereby assure proper draping of a garment thereon while effectively supporting the shoulder regions of the garment so as to prevent the formation of creases in the garment.

Since the shoulder-supporting members of the present invention can be removed from the garment hanger and are shell-like in construction, the members can be stored in a nested relationship with each other to conserve space in luggage or other spaces of limited volume. Moreover, the members can be formed of an unbreakable material, can be of different colors, and can be quickly and easily placed on a garment hanger so as to make it possible always to have a properly shaped hanger readily accessible.

The material of the members can be plastic, laminated wood, paper or cardboard (lacquered for firmness), fiberglass, coated straw matting, coated fabric (such as burlap), metal and even glass. The member can be made to withstand all climatic changes and to be impervious to moisture so that it will not rust or alter in shape. Thus, the member is suitable for hot, humid areas and can also be used safely to dry garments or to steam garments.

The main advantage gained by the use of the shoulder-supporting members of the type described is to eliminate the disfiguring shoulder creases and bumps created by using wire garment hangers. Since the upper surface of each shoulder-supporting member is convex, the member permits the garment on the hanger to hang off a curve, rather than an edge as in wire garment hangers without the members. The members further reduce creasing because they automatically space garments in a closet to at least the widths of the members themselves. The members of the present invention thus transform an ordinary wire hanger into the equivalent of a luxury garment hanger incorporating protective shaping, strength and imperviousness to moisture.

For retail use, the members mounted on a garment hanger help to display clothes more professionally. Thus, a retailer can use the members without requiring the expensive wood garment hangers normally used.

The primary object of the present invention is to provide a shoulder-supporting member for a garment hanger of the type described wherein the member can be formed from any one of a number of different materials, is lightweight and durable in construction, is impervious to moisture and can be nested with other members of the same construction to conserve space.

Other objects of this invention will become apparent as the following specification progresses, reference being had to the accompanying drawings for an illustration of the invention.

IN THE DRAWINGS

DESCRIPTION OF THE PREFERRED EMBODIMENT

Figure 1:
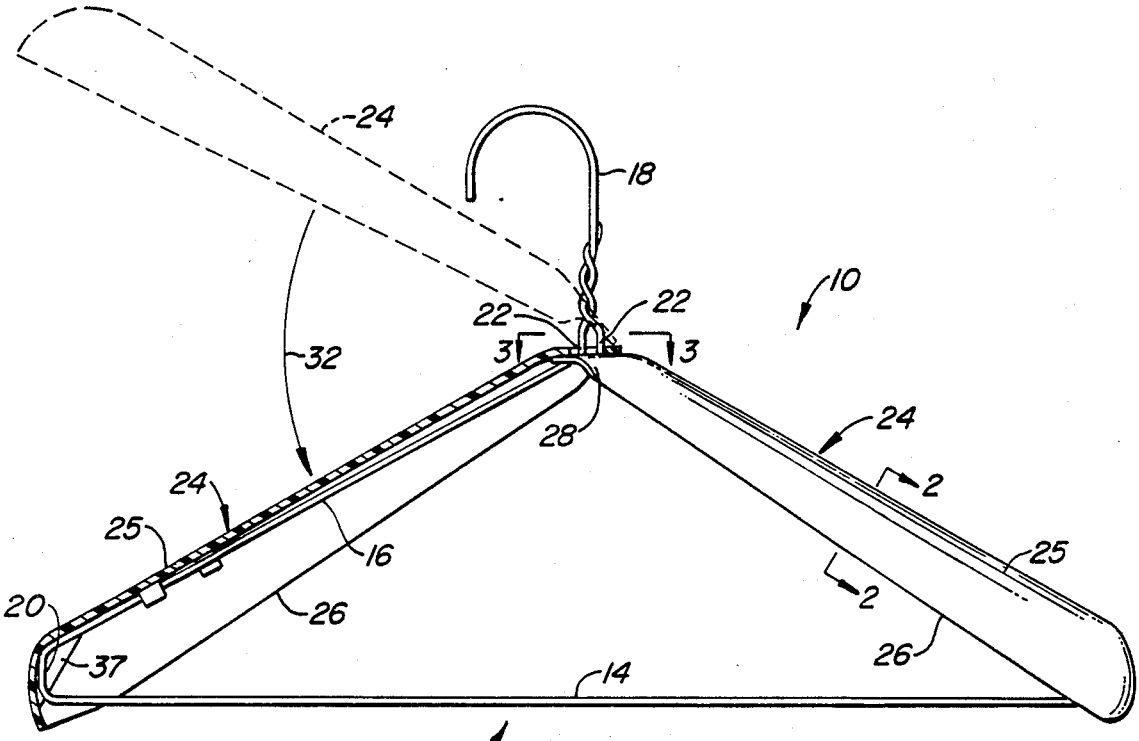
FIG. 1 is a side elevational view, partly in section, of a wire garment hanger having a pair of shoulder-supporting members of the present invention thereon.

The garment hanger assembly using the present invention is broadly denoted by the numeral 10 and includes a wire garment hanger 12 made from a single strand of relatively rigid, bendable wire to form a bottom horizontal segment 14, a pair of inclined side segments 16, and a hook member 18. Bottom segment 14 is integral with inclined side segments 16 at the outer curved ends 20 of side segments 16.

Figure 4:
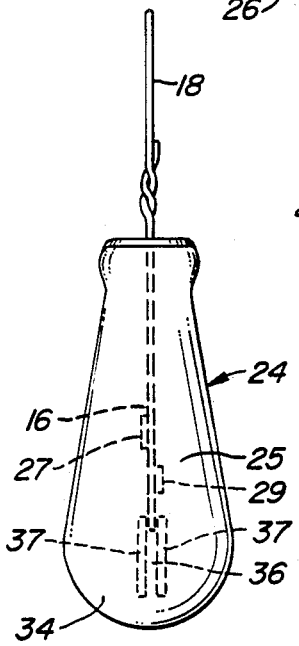
FIG. 4 is an end elevational view of the coat hanger with the members thereon.

One end of the wire forming garment hanger 12 terminates at the outer end of hook segment 18, and the other end of the wire is wrapped around the vertical, lower portion of the hook segment as shown in FIGS. 1 and 4. This feature defines a pair of vertical wire segments 22 which are slightly spaced apart as shown in FIG. 1.

The present invention comprises a shoulder-supporting member 24 for each side segment 16, respectively, of garment hanger 12. A pair of shoulder-supporting members 24 are removably mounted on garment hanger 12 so that they effectively overlie substantially the entire lengths of respective, inclined side segments 16 as shown in FIG. 1. While the lower surfaces of members 24 may engage side segments 16, they can also be slightly spaced above side segments 16 as shown in FIG. 1. The members 24 provide upper, convex garment-engaging surfaces which are a number of times wider than the curved upper surfaces of inclined side segments 16. Thus, members 24 provide greater support for the shoulder region of a garment draped on hanger 12 and prevent the formation of creases in the shoulder areas of the garment.

Each member 24 is substantially identical to the other member; thus, a description of one member will suffice for the other. Moreover, the members are interchangeable on hanger 12; thus, they can occupy either position on the hanger.

Figure 2:
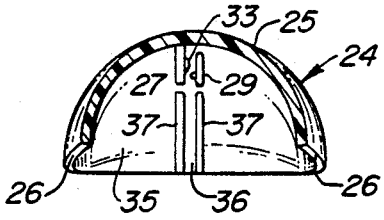
FIG. 2 is a cross-sectional view taken along line 2—2 of FIG. 1.
Figure 3:
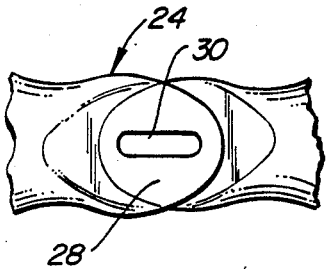
FIG. 3 is a cross-sectional view taken along line 3—3 of FIG. 1.

The cross section of each member 24 is substantially curved as shown in FIG. 2 to present a convex outer surface 25 for engaging a garment in supporting relationship thereto. Each member 24 has side marginal edges 26 which diverge relative to each other as the outer end of the member is approached. Thus, the members have a greater width at their outer ends as shown in FIG. 2 than at their inner ends.

Figure 5:
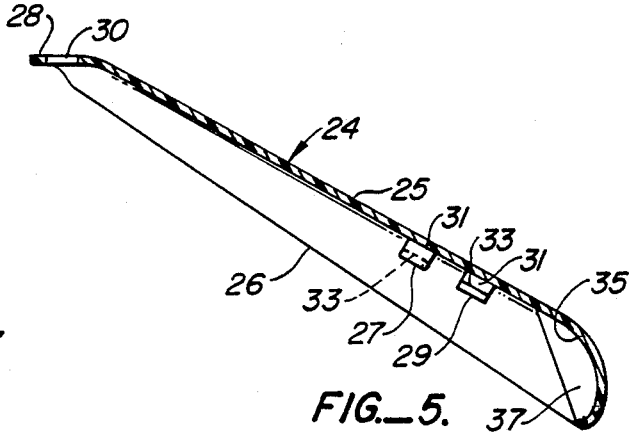
FIG. 5 is a vertical section through one of the members.

At the inner end of each member 24, there is a flat, generally horizontal extension (FIG. 5). Extension 28 has an opening 30 therein for receiving the two vertical segments 22 of hanger 14. FIG. 1 shows a member 24 in dashed lines as the member is being placed on or taken off the hook segment 18. Arrow 32 (FIG. 1) shows the direction of rotative movement of the member as it is being moved onto a segment 16 of hanger 12.

The outer end part 34 of each member 24 is somewhat convex in shape to provide a substantially spherical outer surface (FIGS. 4 and 5). Also, the outer end part 34 of each member 24 on the inner surface 35 (FIGS. 2 and 5) has a pair of parallel, generally rigid flat elements 37 defining a slot 36 (FIGS. 2 and 4) which receives and frictionally engages substantially the entire adjacent outer end 20 of the adjacent side segment 16 as shown in FIG. 1. This structural feature helps to stabilize member 24 on side segment 16 of hanger 12 and prevents the member from tilting when a garment is placed on the members to be hung from hanger 12.

Figure 6:
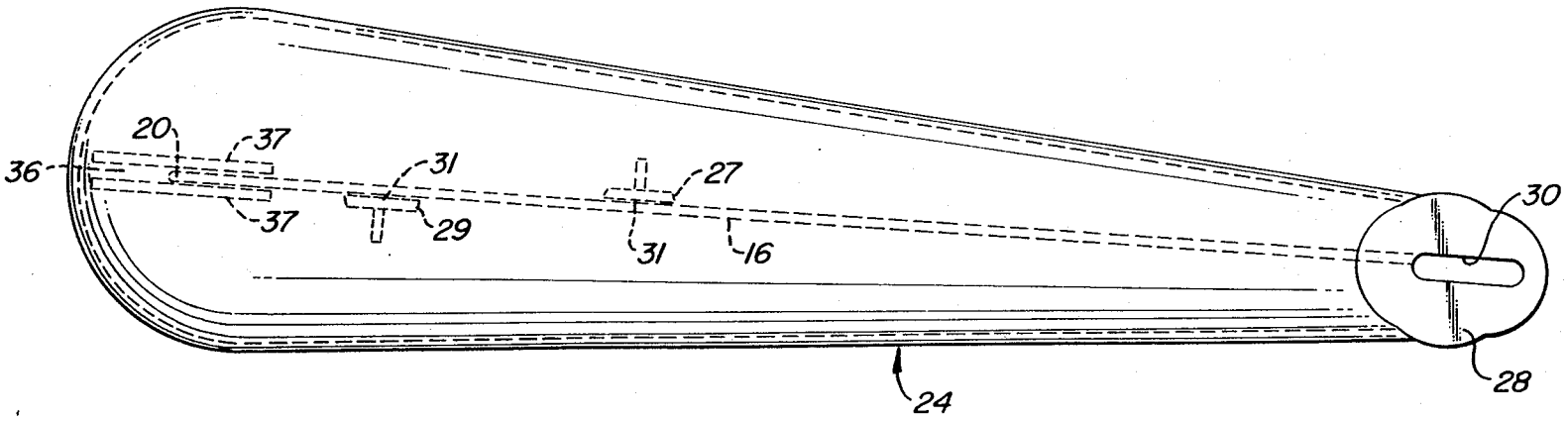
FIG. 6 is a top plan view of a shoulder-supporting member.

To further stabilize each member 24, a pair of longitudinally spaced projections 27 and 29 are provided on the inner surface of each member 24 for frictionally engaging the adjacent portion of the respective side segment 16. Such projections are at specific locations along the length of the inner surface of a corresponding member 24 as shown in FIGS. 1, 5 and 6. As shown in FIG. 6, segment 16 is engaged on one side surface portion by projection 27 and engaged on the opposite side surface portion by projection 29.

Each of projections 27 and 29 has a flat, segment-engaging surface 31 as shown in FIG. 6. The longitudinal length is any value, such as $\frac{1}{8}$ inch to $\frac{1}{2}$ inch, which will give good frictional contact with segment 16. Typically, projections 27 and 29 and elements 37 are integral with members 24. Each surface 31 has a rib or ridge 33 which has a convex outer surface and extends longitudinally of the adjacent segment 16.

To secure segment 16 on projections 27 and 29, pressure is exerted on segment 16 to get it over ridges 33 on the projections. In this way, segment 16 is releasably held since the segment is effectively held at three locations. The segment 16 is secured to member 24 by projections 27 and 29 and prevented from tilting by elements 37.

Members 24 can be of any suitable material. Preferably, they are molded from a plastic material so that they will be of a one-piece construction which is sturdy, lightweight and durable. Moreover, the shell-like construction of members 24 allows them to be nested within each other so that they can be packed or stored without requiring much space. The fact that the members can be easily removed from hanger 12 allows the hangers to be carried in a suitcase in flattened conditions yet, at a destination, members 24 can be placed on the hangers and a quality garment hanger can be formed using only three parts, one of which is a conventional wire garment hanger.

I claim:

1. In a garment hanger, unit having a hook segment and a pair of inclined side segments secured to the hook segment and extending outwardly and downwardly therefrom in opposed directions, the improvement comprising:

a shoulder-supporting member for an inclined side segment of the garment hanger, the member adapted to be removably mounted on the garment hanger in overlying relationship to an inclined side segment and adapted to extend laterally from the corresponding inclined segment to present a garment-engageable, convex upper surface throughout a major portion of its length, the width of each member progressively increasing as the outer end of the member is approached, each member having a substantially spherical outer surface portion at the outer end thereof, the inner end of each member being flat and having an opening therethrough for removably receiving the hook segment of the garment hanger; and means on the member for stabilizing the member when it overlies the corresponding inclined side segment, said stabilizing means including a pair of projections secured to the inner surface of the member and spaced from the outer end of the member and spaced from each other longitudinally of the member so that the projections can frictionally engage the adjacent inclined side segment at longitudinally spaced locations thereon, the projections having flat outer faces for engaging respective, opposite side surface portions of the inclined side segment for receiving and thereby releasably holding the inclined side segment intermediate the ends thereof, there being a pair of oppositely facing spaced, flat elements at the outer end of each member on the inner surface thereof to present a slot therebetween for receiving and thereby positioning substantially the entire outer end of the corresponding side segment relative to the member.

* * * * *